US005117538A

United States Patent [19]

Henry

[11] Patent Number: 5,117,538

[45] Date of Patent: Jun. 2, 1992

[54] DEVICE TO SECURE SUSPENDERS SHOULDER STRAPS

[76] Inventor: Jesse Henry, 5110 Azalea Trace Dr. #2707, Houston, Tex. 77066

[21] Appl. No.: 685,429

[22] Filed: Apr. 15, 1991

[51] Int. Cl.[5] ..... A44B 21/00

[52] U.S. Cl. ..... 24/298; 24/301; 24/306; 40/1.5

[58] Field of Search ..... 24/298, 300, 301, 306, 24/442, 338, 339, 343, 519, 61, 62, 64, 49 CC, 49 A; 40/1.5; 2/10, 195

[56] References Cited

U.S. PATENT DOCUMENTS

| | | | |
|---|---|---|---|
| 161,517 | 3/1875 | Keam | 24/339 |
| 1,014,009 | 1/1912 | Koons | 24/339 |
| 1,341,406 | 5/1920 | Ade | 24/301 |
| 1,782,057 | 11/1930 | Bollinger | 24/301 |
| 1,991,797 | 2/1935 | Drinkwater | 24/49 CF |
| 2,360,815 | 10/1944 | Mungen | 40/1.5 |
| 2,820,269 | 1/1958 | Wolff | 24/300 |
| 3,452,401 | 7/1969 | Trent | 24/301 |
| 4,158,906 | 6/1979 | Watson | 24/306 |
| 4,277,864 | 7/1981 | Orson, Sr. | 40/1.5 |
| 4,707,906 | 11/1987 | Posey | 24/72.5 |

FOREIGN PATENT DOCUMENTS

| | | | |
|---|---|---|---|
| 1161406 | 8/1969 | United Kingdom | 24/306 |

*Primary Examiner*—Victor N. Sakran
*Attorney, Agent, or Firm*—Abdallah & Muckelroy

[57] ABSTRACT

A shoulder strap securing device which selectively engages the shoulder straps of suspenders at one end and the shirt collar or necktie at the opposite end.

13 Claims, 3 Drawing Sheets

DEVICE TO SECURE SUSPENDERS SHOULDER STRAPS

BACKGROUND

The present invention generally relates to suspenders. More particularly, this invention relates to means for securing the shoulder straps of suspenders and the like.

A recurring problem for wearers of suspenders is keeping the suspenders shoulder straps disposed on the shoulders. During normal wear the suspenders shoulder straps often slip from the shoulders causing discomfort and annoyance for the wearer, as well as loss of garment support.

Means to retain the shoulder straps of suspenders and the like in a desired position on the shoulders of the wearer have been disclosed in the prior art. Such means generally comprise a lateral brace extending between the respective shoulder straps of the suspenders formed as an integral part of the suspenders construction. Exemplary suspenders construction including a lateral brace include U.S. Pat. Nos. 295,146 to Campbell; 361,239 to Ralph; 792,078 to Royall; 863,159 to Degenhart; 2,548,742 to Scheinberg. A lateral brace selectively attachable to the shoulder straps of suspenders is disclosed in U.S. Pat. No. 4,858,249 to Stewart. Shoulder strap retention means comprising an integrally-constructed lateral brace are generally uncomfortable to the wearer and must be constructed in a manner to fit a variety of body sizes and shapes.

A suspenders construction having sleeve-straps attached to the respective shoulder straps which are also useful for retention of the shoulder straps on the shoulders of the wearer is disclosed in U.S. Pat. No. 244,581 to Garson.

These prior art suspenders and device for attachment to suspenders provide some utility toward resolving problems of slippage of suspenders shoulder straps. However, they do not provide a functional construction that is comfortable to a wearer and universal in its application. The present invention overcomes these limitations of the prior art references.

SUMMARY OF THE INVENTION

The present invention is a device permitting the shoulder straps of suspenders to be selectively attached to a shirt collar or necktie. The suspenders shoulder straps are thereby retained in a desired position on the shoulders of the wearer.

The shoulder strap securing device of the present invention comprises a suspenders attachment portion and a shirt collar attachment portion which are cooperably engageable to form a single unit. A securing device is provided for each shoulder strap of the suspenders.

Suspenders attachment portion comprises a first attachment strap and a suspenders clip fixedly attached to an end of the first attachment strap. A plurality of strap slots are formed in the first attachment strap. Shirt collar attachment portion comprises a second attachment strap and a shirt collar clip, preferably hingedly attached to an end of the second attachment strap. A slot tab is formed in the second attachment strap that selectively engages a strap slot of the first attachment strap. The suspenders clip selectively attaches to a shoulder strap of the suspenders and the shirt collar clip selectively attaches to a shirt collar or necktie of the wearer.

An object of the present invention is to provide means to retain suspenders shoulder straps in a desired position on the shoulders of the wearer.

Another object of this invention is to provide shoulder strap retention means which can be adjusted to fit different body sizes and shapes.

A further object of the present invention is to provide a shoulder strap securing device of simple construction.

These and other objects and advantages of the present invention will be apparent to those skilled in the art from the following description of preferred embodiments, claims and appended drawings.

DESCRIPTION OF PREFERRED EMBODIMENTS

Figure 1:
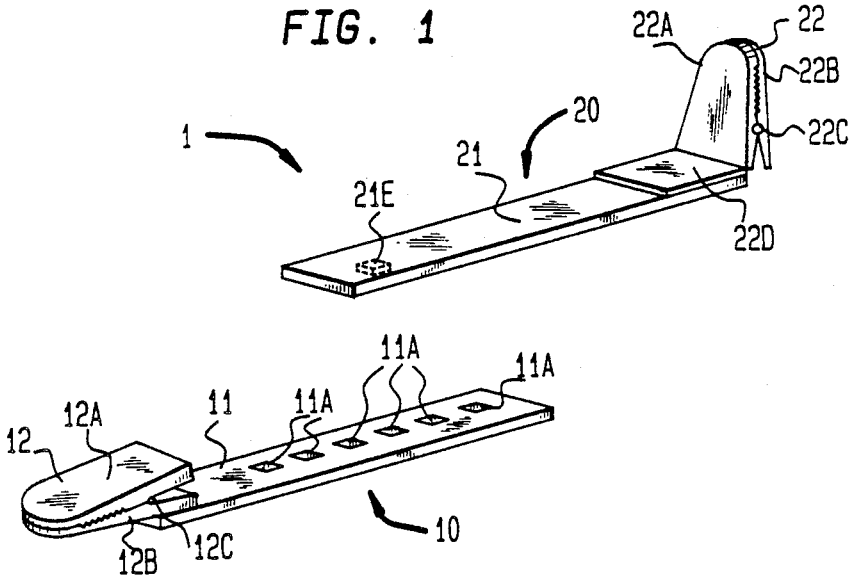
FIG. 1 is a top perspective view of a first embodiment of the shoulder strap securing device of the present invention.

FIG. 1 illustrates in a top perspective view a first embodiment of the shoulder strap securing device 1 of the present invention. Shoulder strap securing device 1 generally comprises a suspenders attachment portion 10 and a shirt collar attachment portion 20 which are selectively and cooperably engageable to form a single unit.

Figure 2:
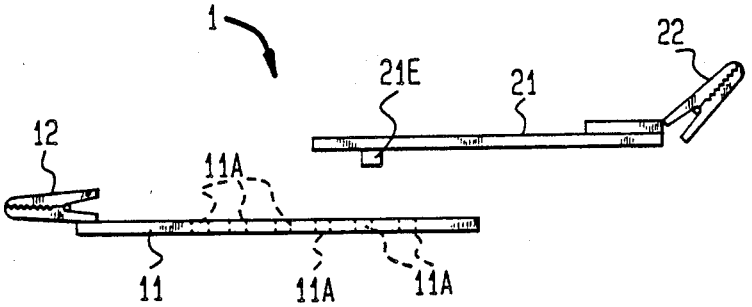
FIG. 2 is a side plan view of the first shoulder strap securing device.

Suspenders attachment portion 10 comprises a first attachment strap 11 and a suspender clip 12 fixedly attached at an end of the first attachment strap Suspender clip 12 is preferably an alligator clip of the type generally known in the art comprising respective upper and lower teethed jaws 12*a*, 12*b* hingedly attached at a mid-portion 12*c* thereof. First attachment strap 11 includes a plurality of strap slots 11*a* formed therein for receipt of the shirt collar attachment portion 20 as hereinafter described in greater detail. Shirt collar attachment portion 20 comprises a second attachment strap 21 and a shirt collar clip 22, fixedly attached at an end of the second attachment strap 21. Shirt collar clip 22 is preferably an alligator clip as heretofore described and is preferably hingedly attached to the second attachment strap 21. In the first preferred embodiment, shirt collar clip 22 includes a hingedly attached clip flap 22*d* for the hinged attachment of shirt collar clip 22 to second attachment strap 21. Second attachment strap 21 includes a slot tab 21*e* selectively receivable in a strap slot 11*a* of the first attachment strap 11 in locking engagement (FIG. 2).

Figure 3:
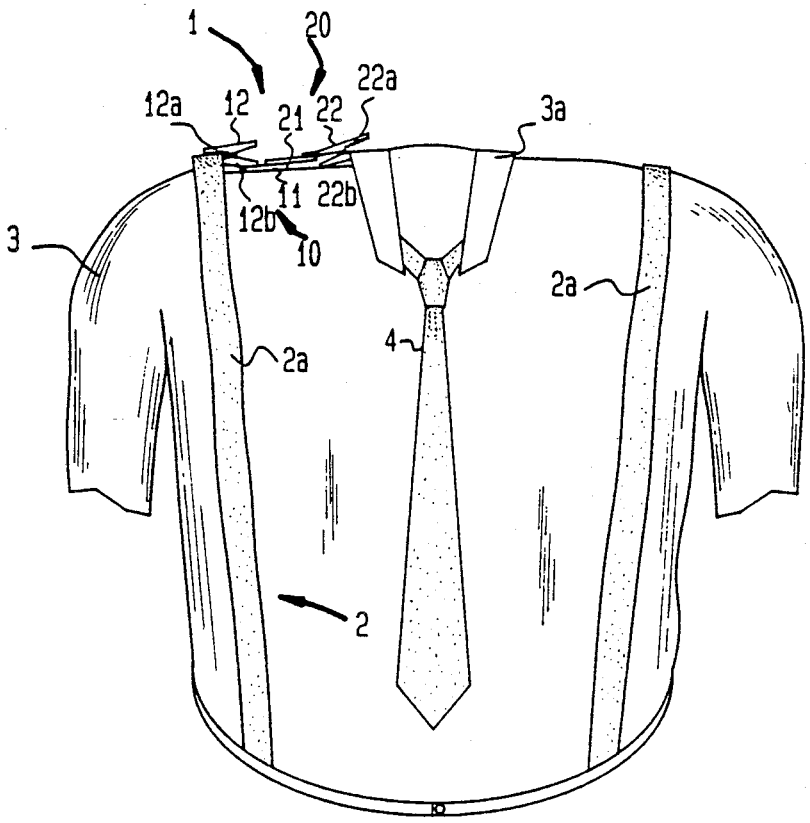
FIG. 3 is a front plan view showing the attachment of the shoulder strap securing device in accordance with the present invention.

FIG. 3 illustrates in a front plan view the attachment of the shoulder strap securing device 1 to a shoulder strap 2*a* of suspenders 2. It should be understood by those skilled in the art that a shoulder strap securing device is required for each shoulder strap of the suspenders 2 with which the present invention is to be utilized. The suspenders shoulder straps 2*a* are first disposed at a desired position on the wearer's respective shoulders. The shoulder strap securing device 1, having the suspenders attachment portion 10 and the shirt collar attachment portion 20 disposed in locking engagement at an appropriate position to retain the shoulder straps 2*a* at the desired position, is attached at one end to shoulder strap 2*a* and at the opposite end to the collar 3*a* of the shirt 3 to the wearer. To this end the suspenders shoulder strap 2*a* is engaged between the teethed jaws 12*a*, 12*b* of the suspender clip 12 of the suspenders attachment portion 10 of the device 1 and the shirt collar 3 of the wearer is engaged between the teethed jaws 22*a*, 22*b* of the shirt collar clip of the shirt collar attachment portion 20 of the device 1. The shoulder straps 2*a* of the suspenders 2 are thereby prevented from slipping from the wearer's shoulders. Shoulder strap securing device 1 is preferably adjustable from 1½" to 3" end-to-end.

Figure 4:
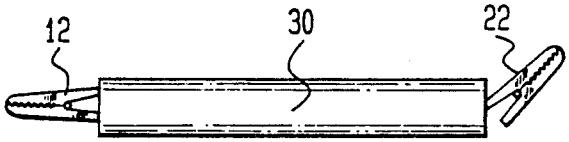
FIG. 4 is a side plan view of the first securing device having a sleeve disposed over the straps thereof.

The shirt collar clip 22 of the shirt collar attachment portion 20 may be alternately attached to a necktie 4 at a portion thereof disposed beneath the shirt collar 3*a*. In this engagement of the shoulder strap securing device 1 the shirt collar clip 22 is concealed from view adding to the aesthetic appeal of the device 1. The first attachment strap 11 and the second attachment strap 21 are preferably formed from a flexible non-elastic material which retains its longitudinal displacement between respective ends thereof, for example a clear, plastic material. The respective first and second attachment straps 11 and 21 may also be covered by a sleeve 30 formed from the same or coordinated material as the material of the shoulder straps 2*a* of the suspenders 2 (FIG. 4) and fixedly disposed thereto.

Figure 5:
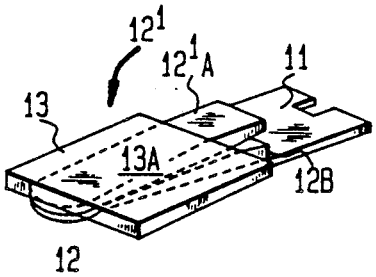
FIG. 5 is a top perspective view of a second embodiment of the suspenders clip of the present invention.
Figure 6:
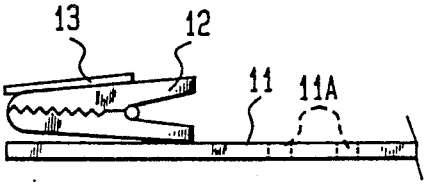
FIG. 6 is a side plan view of the second suspenders clip illustrated in FIG. 5.
Figure 7:
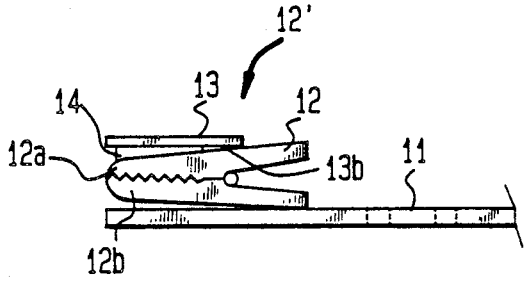
FIG. 7 is an alternate construction of the second suspenders clip.

FIGS. 5–7 illustrate a second embodiment of a suspenders clip 12' suitable for use in the shoulder strap securing device 1 of the present invention. The second suspenders clip 12' comprises an alligator clip 12 as heretofore described and a first suspenders clip cover 13 fixedly attached to the upper jaw 12*a* of the alligator clip 12. First suspenders clip cover 13 is preferably a flat metallic plate member having an engraveable upper surface 13*a*. First suspenders clip cover 13 may be disposed in bearing engagement with the upper jaw 12*a* of alligator clip 12 as illustrated in FIG. 6 or first suspenders clip cover 13 may be angularly disposed from said upper jaw 12*a* as illustrated in FIG. 7. In the latter construction a shim 14 is disposable between the lower surface 13*b* of the first suspenders clip cover 13 and the upper jaw 12*a* of the alligator clip 12 (FIG. 7).

Figure 8:
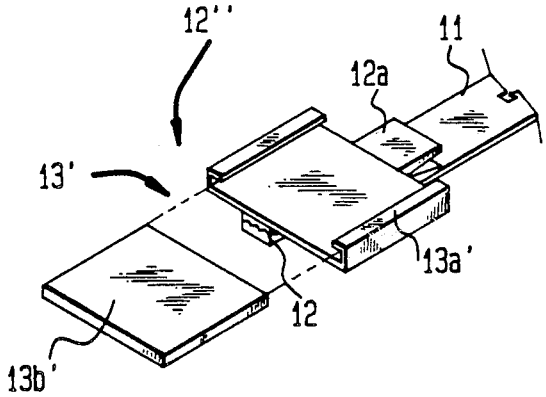
FIG. 8 is a top perspective view of a third embodiment of the suspenders clip of the present invention.

FIG. 8 illustrates a third embodiment of a suspender clip 12" suitable for use in the shoulder strap securing device 1 of the present invention. The third suspenders clip 12" comprises an alligator clip 12 as heretofore described and a second suspenders clip 13' fixedly attached to the upper jaw 12*a* of the alligator clip 12. Second suspenders clip cover 13' comprises a clip cover receptacle 13*a*' and a clip cover plate 13*b*' selectively receivable in said clip cover receptacle 13*a*'. The preferred construction of clip cover receptacle 13*a*' is a framed member having slotted vertical walls which receive clip cover plate 13*b*' in sliding engagement. Clip cover plate 13*b*' is preferably formed having an engraveable upper surface. The third suspenders clip 12" permits simple interchanging of the clip cover plate 13*b*' for ready adjustment of the device to different color and style combinations.

The shoulder strap securing device 1 of the present invention provides a simple construction that retains the shoulder straps 2*a* of suspenders 2 in a desired position. Various changes and modifications to the preferred embodiments described and illustrated may be made without departing from the spirit and scope of this invention. For example, the respective suspenders attachment portion 10 and the shirt collar attachment portion 20 may be slidably attached for selective adjustment of the length of the device. Such changes and modifications within a fair reading of the appended claims are intended as part of the present disclosure.

Therefore, in view of the foregoing I claim:

1. A device for securing a shoulder strap of suspenders in a desired position on a shirted wearer, said device comprising a suspenders attachment portion selectively attachable to a shoulder strap of the suspenders by gripping means, said suspenders attachment portion comprising a first attachment strap and a first clip, said first clip being hingedly attached to an end of said first attachment strap, said first attachment strap having a plurality of strap slots formed therein; and a shirt collar attachment portion selectively attachable to a shirt collar of the wearer by gripping means, said shirt collar attachment portion comprising a second attachment strap and a second clip, said second clip being hingedly attached to an end of said second attachment strap, said second attachment strap having a slot tab formed therein selectively receivable in a strap slot in locking engagement.

2. A device as in claim 1 wherein said first clip comprises as alligator clip.

3. A device as in claim 2 wherein said second clip comprises an alligator clip.

4. A device as in claim 1 further including a non-transparent clip cover fixedly attached to a portion of the first clip of said suspenders attachment portion.

5. A device as in claim 4 wherein said clip cover comprises a flat metallic member having an engraveable upper surface.

6. A device as in claim 4 wherein said clip cover comprises a clip cover receptacle and a cover plate selectively receivable in said clip cover receptacle, said clip cover receptacle being fixedly attached to a portion of the first clip of said suspenders attachment portion.

7. A device as in claim 6 wherein said clip cover plate comprises a flat metallic member having an engraveable upper surface.

8. A device as in claim 6 wherein said clip cover plate is selectively receivable in the clip cover receptacle in slidable engagement.

9. A device for securing a shoulder strap of suspenders in a desired position on a shirted wearer, said device comprising a suspenders attachment portion selectively attachable to a shoulder strap of the suspenders by gripping means, said suspenders attachment portion comprising a first attachment strap and a first clip, said first clip being fixedly attached to an end of said first attachment strap;

a shirt collar attachment portion selectively attachable to a shirt collar of the wearer by gripping means, said shirt collar attachment portion comprising a second attachment strap and a second clip, said second clip being hingedly attached to an end of said second attachment strap, said first attachment strap and said second attachment strap being cooperably engageable at selectively adjustable positions; and further including a sleeve fixedly disposed about the respective first and second attachment straps of said suspenders attachment portion and the shirt collar attachment portion.

10. A device as in claim 6 further including a clip cover fixedly attached to a portion of the first clip of said suspenders attachment portion, said clip cover comprising a flat, non-transparent metallic member having an engraveable upper surface.

11. A device as in claim 9 further including a clip cover fixedly attached to a portion of the first clip of said suspenders attachment portion, said clip cover comprising a clip cover receptacle and a non-transparent cover plate selectively receivable in said clip cover receptacle, said clip cover receptacle being fixedly attached to a portion of the first clip of said suspenders attachment portion.

12. A device as in claim 11 wherein said clip cover plate is formed having an engraveable upper surface.

13. A device as in claim 11 wherein said clip cover plate is selectively receivable in said clip cover receptacle in slidable engagement.

* * * * *